United States Patent [19]

Unverzagt

[11] Patent Number: 4,773,653

[45] Date of Patent: Sep. 27, 1988

[54] COVER FOR BALLISTIC TARGET ASSEMBLY

[75] Inventor: Richard H. Unverzagt, Roswell, Ga.

[73] Assignee: Linatex Corporation of America, Stafford Springs, Conn.

[21] Appl. No.: 5,210

[22] Filed: Jan. 20, 1987

[51] Int. Cl.[4] ..... F41J 1/12; F41J 3/02

[52] U.S. Cl. ..... 273/404; 273/408; 273/410

[58] Field of Search ..... 273/404, 408, 410

[56] References Cited

U.S. PATENT DOCUMENTS

| | | | |
|---|---|---|---|
| 1,886,562 | 11/1932 | Fever | 273/404 |
| 3,122,367 | 2/1964 | Dale | 273/404 |
| 4,076,246 | 2/1978 | Meyer | 273/404 |
| 4,247,116 | 1/1981 | McQuary | 273/408 |
| 4,317,572 | 3/1982 | Iseli | 273/404 |
| 4,470,604 | 9/1984 | Hoffmann | 273/404 |

*Primary Examiner*—Leo P. Picard
*Assistant Examiner*—Gary Jackson
*Attorney, Agent, or Firm*—Chilton, Alix & Van Kirk

[57] ABSTRACT

A splatter resistant removable cover slips over a ballistic target for containing backsplatter. The cover is constructed from panels which form an envelope surrounding the target with one of the panels being spaced forwardly from the target face. A second panel engages the back portion of the target to removably secure the cover in fixed position with the target. A projectile which is directed at the target penetrates a panel which is formed of elastomeric material and strikes the target to form fragments which are generally initially contained within the cover.

20 Claims, 1 Drawing Sheet

COVER FOR BALLISTIC TARGET ASSEMBLY

BACKGROUND OF THE INVENTION

This invention relates generally to fragment containment covers for ballistic targets. More particularly, the present invention relates to replaceable target covers for reducing the lead backsplatter resulting from bullets striking or richocheting off of indoor or outdoor knock-down type targets.

The adverse consequences resulting from backsplatter and ricocheting of bullets at indoor or outdoor target ranges has long been recognized. Numerous devices and assemblies have been advanced to address such problems. For example, sheets of material such as canvas, plywood and particle board have been mounted behind targets as backing curtains to reduce the backsplatter of lead. The noted materials provide some beneficial effects such as reducing lead contamination, reducing range noise level, and reducing airborne contamination but do not adequately confine the backsplatter of lead. Moreover, such materials are generally not used for close range shooting or with knock-down type targets.

SUMMARY OF THE INVENTION

The present invention is a new and improved splatter resistant cover for a ballistic target which slips over the target and employs tough, long lasting elastomer material to reduce backsplatter from bullets striking the target. The cover is especially well suited for knock-down type targets and close range shooting. The cover has very favorable fragment containment characteristics and an extended useful life. In addition, the cover is disposable and is easily replaceable.

Briefly stated, the invention in a preferred form is a cover which slips over a target to form a target assembly adapted to initially retain the backsplatter from projectiles which strike the assembly. The assembly comprises a target plate having a target face and an opposing back side portion. A fragment confining cover for enclosing the target plate comprises a front panel of elastomeric material, a rear panel and a side panel which connects the front and rear panels so as to form an envelope surrounding the target. The front panel is generally spaced from the target face to form a cavity between the target face and the front panel to capture and confine projectile fragments. The rear panel engages the back portion of the target to secure the cover in its fixed position on the target. A projectile directed at the target face penetrates the front panel and strikes the target face to disintegrate into fragments which are generally initially confined within the cover and controllably discharged to the base of the target.

A discharge opening is formed through the side panel to permit discharge of the fragments in a controlled manner to the base of the target. The elastomeric material preferably has a very low elastic modulus and high elongation at break. The side panel preferably comprises a stiffening layer of elastic material that may include a reinforcing material which has a high resistance to stretch and good impact resistance. The rear panel and the side panel cooperate to form an interior mounting gap or recess for receiving peripheral portions of the target plate for securely seating the target plate in fixed relationship with the liner. The target plate typically has a substantially disc-like shape with the front and rear panels being substantially parallel. It may also have the shape of a human silhouette or other shape.

An object of the invention is to provide a new and improved target cover for fragment containment which reduces backsplatter and provides a cleaner environment on the target range.

Another object of the invention is to provide a new and improved target cover which is adaptable for being relatively easily installed or mounted on conventional knock-down type targets or close range targets.

A further object of the invention is to provide a new and improved target cover of efficient and inexpensive construction which may be relatively easily replaceably mounted on a conventional knock-down type target to effectively reduce the lead backsplatter from bullets striking the target.

Other objects and advantages of the invention will become apparent from the specification and the drawings.

DETAILED DESCRIPTION OF THE INVENTION

Figure 1:
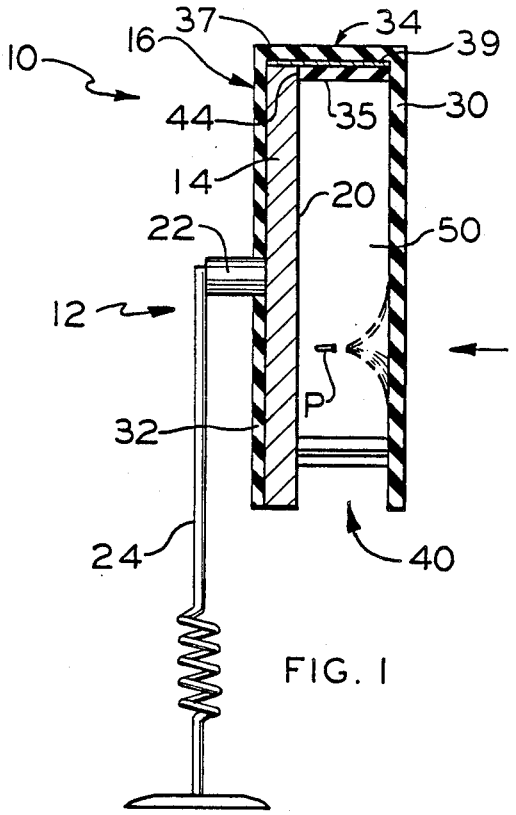
FIG. 1 is a side sectional view of a target assembly employing a splatter resistant cover in accordance with the present invention, portions of the assembly being illustrated in broken lines to illusrate the impact of a projectile engaging the assembly.

With reference to the drawings wherein like numerals represent like parts throughout the figures, a target assembly employing a splatter resistant cover in accordance with the present invention is generally designated by the numeral 10. Target assembly 10 is a knock-down type target assembly which is adapted to be knocked down when a bullet strikes the target. Accordingly, a counterweight or a return mechanism such as a recoil spring assembly 11 may be mounted in connection with the target assembly to return the target to the normal upright position illustrated in the drawing. It should be appreciated that the present invention is not limited to knock-down type targets or to the target configuration illustrated in the drawings.

The target assembly generally comprises a mounting support 12, a steel target 14 and a replaceable cover 16 which is slipped over the target 14 in a quasi glove-like fashion. The mounting support 12 extends from the recoil spring assembly 11 to support the target 14 in the illustrated normal upright orientation. The target 14 and cover 16 cooperate to substantially reduce the backsplatter of lead and fragments ricocheting from bullets striking the target assembly.

Target 14 is an armor-type steel plate of conventional form which in one conventional embodiment has a diameter of about 8–12 inches and a thickness of about ⅜ inch. The target 14 is shown as having the shape of a circular disc of uniform thickness. The target 14 in a normal elevated, upright orientation forms a planar target surface 20 which is generally vertically disposed.

A support bracket 22 extends from the rear of the target plate and connects with a vertical support shaft 24 for supporting the target plate in the normally upright position. When a bullet or projectile strikes the target surface 20, the target plate is knocked rearwardly or recoils from the illustrated vertical orientation. The target is ordinarily quickly returned to the vertical orientation to refunction as a target by recoil spring assembly 11 or any of a number of other conventional means (none of which are illustrated).

The cover 16 is a one piece resilient flexible member which is adapted to be easily slipped over the target plate 14 in a quasi glove or sock-like fashion. Cover 16 generally assumes the form of a disc-shaped envelope or pouch having an elongated opening or slot 42 through an edge thereof. Accordingly, cover 16 comprises a circular front panel 30 and an opposing circular rear panel 32 which is generally secured in equidistantly spaced parallel relationship to the front panel 30 by a multi-layer side panel 34. Side panel 34 extends along the circumferential edge of the cover. Panel 34 functions as a connecting, support and seating structure for the cover and has somewhat more of a rigid form than that of flexible panels 30 and 32. In a preferred form, panel 34 comprises three adjacent, concentric layers 35, 37 and 39. The ends of the side panel 34 terminate to form the lower discharge opening 40 or angularly extending slot through the cover edge.

In one form of the invention, panel 30 and layers 35 and 37 are formed from sheets of abrasion resistant elastomeric material of very low modulus. A suitable elastomeric material is "Linatex" rubber marketed by the Linatex Corporation of America, Stafford Springs, Connecticut. The noted Linatex elastomeric material has a high concentration of pure natural rubber latex with a durometer hardness of 40 on the Shore A scale, a density of 0.98 grams/cc, a tensile strength of 3,000 p.s.i. normal, and a very low elastic modulus. Other abrasion resistant elastomeric materials may also be employed such as natural rubber e.g. cispolyisoprene or transpolyisoprene as well as synthetic elastomers such as ethylene propylene terpolymers, polyolifins including chlorosulfonated polyethylene, butadiene-styrene and butadiene-acrylonitrile copolymers, isobutyl and polyurethane rubbers.

Layer 39 comprises a reinforcement type material which functions to structurally reinforce the periphery of the cover, prevent fragment discharge through side panel 34, enhance the resistance of adjacent layers 35 and 37 to backsplatter an reinforce the bonding interfaces of the cover components. Layer 39 generally provides reinforcement at the front face of the target where splatter fragments impact the side panel. Layer 39 is preferably a bullet resistant material such as metal, polycarbonate or aramid fabric. In this connection, fabric made from aramid fibers such as Kevlar fibers marketed by E. I. duPont deNemours and Co. of Wilmington, Del., etc., may be employed. The foregoing Kevlar fabric is essentially five times stronger than steel, has a high resistance to stretch, tear, puncture and heat and is conventionally used in bullet resistant vests and other bullet resistant materials and as a reinforcing fabric. Other fabric materials having similar properties are also suitable for layer 39. Layer 39 may comprise multiple layers or may be omitted for configurations wherein layers 35 and 37 provide sufficient rigidity and reinforcement characteristics.

Layers 37 and 39 have generally uniform equal widths with the opposing side edges of the layer strips engaging peripheral surface portions of panels 30 and 32. Inner layer 35 preferably is narrower and extends rearwardly from panel 30 to terminate in an exposed rear edge or shoulder 44 at an intermediate position thereby forming an internal angularly extending gap or recess between the rim 44 of the layer 35 and panel 32. The rear edge 44 of layer 35, the forward surface of panel 32, and interior surface of layer 39 cooperate to form a well-defined, three sided locating seat for target 14 wherein the peripheral portions of the target plate are closely received in the formed gap with the seat defining surfaces resiliently engaging the target plate. In addition, layer 35 functions as a spacer element to maintain the spaced relationship between panel 30 and target surface 20 upon mounting the cover to the target.

Figure 3:
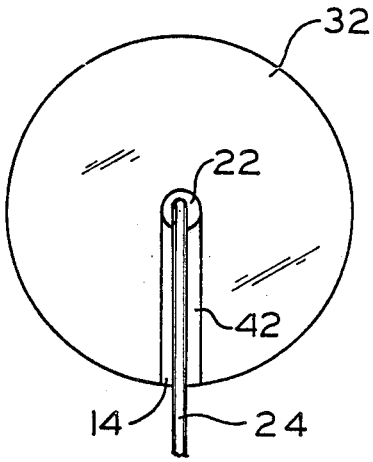
FIG. 3 is a fragmentary rear view of the target assembly of FIG. 1.

The foregoing panels 30 and 32 and layers 35, 37, and 39 are bonded together by means of rubber adhesive or are molded together to form the illustrated resilient, disc-like envelope or pouch construction. The side panel 34 has a quasi-rigid type construction. A slot 42 may be formed in rear panel 32 to accommodate the projecting rear support 22 to permit the cover to be slipped over the target as best illustrated in FIG. 3.

The cover 16 is slipped over the target 14 through slot 40 in a generally downward direction so that the rear panel 32 engages the rear side of the target and the target is received in the gap formed by the rear edge 44 of layer 35 and seated in position as previously described with the side panel layers 35, 37 and 39 cooperating to keep the front panel 30 in spaced relationship to the target surface 20. Inner elastomeric layer 35 functions to define the spaced relationship between the front panel 30 and the target surface 20 so that a thin disc-shaped cavity 50 is formed between the target and the front panel. Because of the elasticity of the materials which define slot 40, slot 40 may momentarily deformably elongate to accommodate the maximum diametral dimension of the target during the cover installation process. The discharge opening or slot 40 is located at the underside of the installed cover upon completion of the installation process.

In one form of the invention for a target with dimensions previously described, the rear panel 32 has a thickness of $\frac{1}{8}$ inch, the front panel 30 has a thickness of $\frac{1}{4}$ inch and layers 35 and 37 each have a thickness of $\frac{1}{4}$ inch. The formed cavity 50 has a thickness of approximately 1 inch and a diameter on the order of 8 inches.

With reference to FIG. 1, a projectile P which is directed toward the target in the direction of the arrow penetrates panel 30 in a fashion wherein the panel resiliently stretches from the normal planar configuration toward the target surface 20 in the vicinity of the projectile impact as schematically illustrated in broken lines (drawing may not be drawn to scale nor accurately portray projectile/panel impact). The projectile P penetrates panel 30. The panel 30 quickly elastically rebounds to the planar configuration with a perforation being formed at the penetration location of the projectile. The formed perforation is quite small and significantly smaller than the diameter of the penetrating projectile due to the elastic qualities of the elastomeric material.

The projectile P impacts against the steel target surface 20. The impact normally produces a generally radially directed sunburst effect resulting from the projectile disintegrating into numerous small fragments and a backsplattering of lead. The fragments which rebound or are backsplattered by the target are initially substantially confined within cavity 50 by the front panel 30 as well as the side panel 34. Most of the backsplatter initially strikes the inner surface 35 of the side panel 34. Panel 30 has sufficient elasticity and impact resistance and panel 34 has sufficient rigidity to deflect or repel the backsplatter with the backsplatter fragments ultimately falling through the discharge opening 40. Some fragments may directly scatter or rebound through opening 40 to harmlessly collect at the base of the target assembly or on the floor. The front panel 30 has penetration selective characteristics which permits initial penetration of a projectile from the forward direction, but deflects or repels the backsplatter of lead and other projectile fragments. The resiliency of the front panel 30 also functions to dissipate the impact forces.

The rear panel 32 functions to both secure the cover 16 in correct relationship to the target and to facilitate the absorption of the projectile induced impact which is transmitted through the sides and top portions of the side panel 34. Rear panel 32 may also be formed of elastomeric material.

The target assembly comprising the target 14 and cover 16 in accordance with the invention will function to reduce the backsplatter of projectiles striking the steel target plate for a large number of firings before the effectiveness of the cover 16 in reducing backsplatter becomes imperiled due to the resulting multiple perforations in panel 30. A sufficiently high density of perforations eventually impairs the structural integrity and in particular the elastic properties of the front panel 30. The cover 16 may, however, be relatively easily removed by upwardly pulling the cover from the target plate. A new cover may then be positioned over the target plate as previously described.

It will, of course, be appreciated that the cover 16 is necessarily conformal with the target 14. Accordingly, the cover 16 may assume a wide variety of shapes and sizes corresponding to a given target configuration in accordance with the present invention. It is preferable that the discharge opening 40 be positioned so that the projectile fragments will essentially be discharged through the opening under the force of gravity. Opening 40 also functions to provide an access slot for receiving the target plate during installation.

In one example, demonstrating the effectiveness of target assembly 10, over 300 rounds of ammunition were fired at a target assembly 10 as previously described. The ammunition included 9 mm, .38 wadcutter and .45 caliber ammunition. A sheet was positioned in front of the target assembly 10. An opening having a shape and dimensions commensurate with target plate 14 was cut in the sheet at a location in horizontal alignment with the target 14. After the ammunition was fired, the sheet was inspected and no traces of bullet fragments were found to go through the sheet. The bullet fragments from the ammunition striking the target assembly were discharged through the opening 40 at the bottom of the target assembly and recovered. Ninety percent of the fired ammunition was recovered in fragment form at the base of the target below the opening 40.

Panel 32 essentially functions to removably secure the front and side panels to the target plate so as to form cavity 50 and to position panel 30 in spaced relationship to target plate 14. In an alternative embodiment, panel 32 is omitted and the front and side panels are secured to the target plate by one or more resilient straps or flaps connecting the side panel. Other securing means may also be employed. A cover in accordance with the invention may also be constructed without layer 39 which primarily functions to prevent radially directed backsplatter from penetrating the cover and adversely impairing the bonds between the elastomer components. In other alternative embodiments (not illustrated) which do not employ panel 32, the presence of opening 40 may not be required although the projectile fragments will be retained within the cavity 50 and eventually reduce the effective life of the cover.

Figure 4:
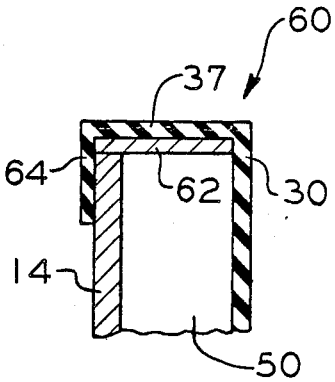
FIG. 4 is a fragmentary side sectional view of a target assembly employing an alternate embodiment of a splatter resistant cover in accordance with the present invention.
Figure 2:
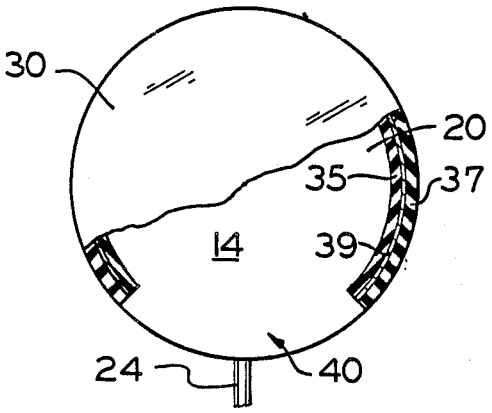
FIG. 2 is a fragmentary front view, partially broken away, of the target assembly of FIG. 1.

With reference to FIG. 4, another embodiment of a splatter resistant cover generally designated by the numeral 60 has a side panel which comprises an inner layer 62 of bullet resistant metal or polycarbonate and outer elastomeric layer 37. Inner layer 62 has a rigid structure which is dimensioned to closely slidably engage the peripheral edge of target 14. The cover is secured to the target by means of a flap 64 of elastomeric material which resiliently engages peripheral back portions of the target.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A target asembly for containment of backsplatter from projectiles striking the assembly comprising:

target means for impacting by a projctile without significant penetation thereof, said target means having a target face an an opposing back portion; and cover means for removably covering said target means comprising a first panel of elastomeric material, a second panel and side panel means for connecting said first and second panels so as to form an evelope surrounding said target means with said first panel being generally spaced from said target face to form a central cavity therebetween and said second panel engaging the back portion of the target means to secure the cover means in fixed position to the target means so that a projectile directed at said target face penetrates said first panel and strikes the target means to form fragments which impact against said cover means for generally initial containment within said cavity,

2. The target assembly of claim 1 wherein an opening is formed through said side panel means.

3. The target assembly of claim 1 wherein the elastomeric material is an abrasion resistant material having a very low modulus of elasticity.

4. The target assembly of claim 1 wherein said side panel means comprises two concentric layers of elastomeric material and a layer of reinforcing material having a high resistance to stretch with the reinforcing material being interposed between the elastomeric layers.

5. The target assembly of claim 1 wherein the second panel and the side panel means cooperate to form an internal gap for receiving peripheral portions of said target means for securely seating said target means in fixed relationship with said cover means.

6. The target assembly of claim 1 wherein the target means has a substantially disc-like shape.

7. The target assembly of claim 1 wherein the first and second panels are substantially parallel.

8. The target assembly of claim 1 wherein the side panel means comprises two adjacent layers, one said layer being formed of polycarbonate material and the other said layer being formed of an elastomeric material.

9. The target assembly of claim 1 wherein the side panel means comprises two adjacent layers, one said layer being formed of metal and the other said layer being formed of an elastomeric material.

10. A cover for mounting on an armor plate-type target for containment of backsplatter from projectiles striking the target comprising:

front panel means comprising a sheet of elastomeric material;

side panel means extending from said front panel means and forming an envelope which is dimensioned and adapted to seat against the target so that the front panel means is generally spaced from said seated target to form a cavity therebetween; and rear securing means connecting said side panel means for removably securing the cover in fixed position on the target, wherein when said envelope is seated against the target, said front panel means is sufficiently spaced from said target and said elastomeric material has properties to permit a projectile directed at the seated target to elongate the elastomeric material to form an opening which subsequently is reduced whereby the projectile penetrates said front panel means and strikes the target to form fragments which impact against the envelope for generally initial containment within the cavity.

11. The cover of claim 10 wherein said side panel means further forms a slot which is dimensioned to accommodate the maximum diametral dimension of the target.

12. The cover of claim 10 wherein the front panel means has a thickness which is greater than that of the rear securing means.

13. The cover of claim 10 wherein the front panel means and the rear securing means are each formed from sheets of elastomeric material having a substantially circular shape.

14. The cover of claim 10 wherein the side panel means comprises layers of elastomeric material and an ajacent layer of reinforcing material having a high resistance to stretching.

15. The cover of claim 10 wherein the elastomeric material is an abrasion resistant material having a very low modulus of elasticity.

16. The cover of claim 10 wherein the cavity has a thin disc-like shape.

17. The cover of claim 10 wherein the side panel means comprises two adjacent layers, one said layer being formed of a polycarbonate material and the other said layer being formed of an elastomeric material.

18. The cover of claim 10 wherein the side panel means comprises two adjacent layers, one said layer being formed of metal and the other said layer being formed of an elastomeric material.

19. A target assembly for containment of backsplatter from projectiles striking the assembly comprising:

target cover means comprising a first panel of elastomeric material, a second panel spaced from said first panel and side panel means for connecting said first and second panels so as to form an envelope having a projectile confining cavity, said cover means comprising seating means for seating said target means in fixed relationship with said first panel; and target means seated in said seating means and mounted within the cavity of the target cover means and enclosed thereby for absorbing the impact of projectiles passing through said elastomeric panel without allowing significant penetration thereof;

so that a projectile directed at said target assembly penetrates said first panel and strikes the target means to form fragments which are at least initially contained within said activity.

20. The cover of claim 10 wherein said side panel means further comprises two concentric layers of elastomeric material and a layer of reinforcing material having a high resistance to stretch with the reinforcing material being interposed between the elastomeric layers.

* * * * *

UNITED STATES PATENT AND TRADEMARK OFFICE

CERTIFICATE OF CORRECTION

PATENT NO. : 4,773,653

DATED : September 27, 1988

INVENTOR(S) : Richard H. Unverzagt

It is certified that error appears in the above-identified patent and that said Letters Patent is hereby corrected as shown below:

Claim 1, line 1, "asembly" should be --assembly--

Claim 1, line 3, "projctily" should be --projectile--

Claim 1, line 4, "penetation" should be --penetration--

Claim 1, line 5, "an" (first occurence) should be --and--

Claim 1, line 11, "evelope" should be --envelope--

Claim 14, line 3, "ajacent" should be --adjacent--

Signed and Sealed this

Eleventh Day of July, 1989

*Attest:*

*Attesting Officer*

DONALD J. QUIGG

*Commissioner of Patents and Trademarks*